US005961180A

United States Patent [19]

Greger et al.

[11] Patent Number: 5,961,180

[45] Date of Patent: Oct. 5, 1999

[54] JUVENILE CARRIER WITH ADJUSTABLE HANDLE ASSEMBLY

[75] Inventors: Jeff G. Greger, Lititz; Robert T. Pike, Reading, both of Pa.

[73] Assignee: Graco Children's Products Inc., Elverson, Pa.

[21] Appl. No.: 08/926,983

[22] Filed: Sep. 10, 1997

[51] Int. Cl.[6] ..... A47D 13/02

[52] U.S. Cl. ..... 297/183.4; 297/183.2

[58] Field of Search ..... 297/183.1, 183.2, 297/183.4, 183.3

[56] References Cited

U.S. PATENT DOCUMENTS

| | | | |
|---|---|---|---|
| D. 311,822 | 11/1990 | Meeker | D6/333 |
| D. 353,288 | 12/1994 | Kain | D6/502 |
| D. 369,707 | 5/1996 | Kain | D6/502 |
| 3,334,944 | 8/1967 | Gould et al. | 297/377 |
| 3,409,325 | 11/1968 | Hamilton et al. | 297/377 |
| 3,492,047 | 1/1970 | Dudouyt | 297/377 |
| 3,528,701 | 9/1970 | Laughlin | 297/377 |
| 4,371,206 | 2/1983 | Johnson, Jr. | 297/183 |
| 4,545,613 | 10/1985 | Martel et al. | 297/250 |
| 4,634,175 | 1/1987 | Wise | 197/183 |
| 4,634,177 | 1/1987 | Meeker | 297/250 |
| 4,668,850 | 5/1987 | Brownlie et al. | 297/270 |
| 4,681,368 | 7/1987 | Heath et al. | 297/250 |
| 4,697,845 | 10/1987 | Kamman | 297/377 X |
| 4,744,599 | 5/1988 | Jankowski et al. | 297/250 |
| 4,858,997 | 8/1989 | Shubin | 297/487 |
| 4,943,113 | 7/1990 | Meeker | 297/250 |
| 4,982,997 | 1/1991 | Knoedler et al. | 297/296 |
| 4,986,599 | 1/1991 | Wise | 297/183 |
| 5,011,221 | 4/1991 | Wise | 297/191 |
| 5,052,749 | 10/1991 | Groenendijk | 297/250 |
| 5,092,004 | 3/1992 | Cone et al. | 5/94 |
| 5,133,567 | 7/1992 | Owens | 280/30 |
| 5,143,419 | 9/1992 | Tepper et al. | 297/183 |
| 5,188,380 | 2/1993 | Tucek | 280/30 |
| 5,244,292 | 9/1993 | Wise | 403/93 |
| 5,265,932 | 11/1993 | Leonard | 297/131 |
| 5,277,472 | 1/1994 | Freese et al. | 297/130 |
| 5,322,343 | 6/1994 | Parker et al. | 297/183 |

(List continued on next page.)

FOREIGN PATENT DOCUMENTS 1404666 2/1969 Germany .

OTHER PUBLICATIONS

Sell sheet, Juvenile carrier with adjustable handle assembly; Cosco, Inc., 2525 State Street, Columbus, Indiana 47201. Publication date Mar., 1997.

P. 1, Juvenile carrier with adjustable handle assembly; Kolcraft Enterprises, Inc., 3455 West 31st Place, Chicago, Illinois 60623. Publication date 1997.

Pp. 2, 22 and 25, Juvenile carriers with adjustable handle assembly; Century Products Company, 9600 Valley View Road, Macedonia, Ohio 44056. Publication date 1996.

Pp. 2, 3 and 5, Juvenile carriers with adjustable handle assembly; Evenflo Company, Inc., a Lisco Company, 601 South Harbour Island Boulevard, Suite 200, Tampa, Florida 33602. Publication date 1996.

*Primary Examiner*—PEter R. Brown
*Attorney, Agent, or Firm*—Richard B. O'Planick

[57] ABSTRACT

Disclosed is a juvenile carrier including a frame including a seating portion for receiving a juvenile and a locking member receiving portion, a circular locking member adapted to engage the locking member receiving portion, a handle rotatably connected to the frame, and a handle actuator disposed proximate to the handle. Also disclosed is a adjustable handle assembly including a rotatable handle, a handle actuator disposed proximate to the handle, and a circular locking member disposed proximate to the handle actuator. The handle actuator is adapted to engage and move the circular locking member in an axial direction to allow the handle to be adjusted to and locked in a plurality of rotational positions. Also, the circular locking member includes a plurality of teeth disposed about its circumference and is adapted to engage the handle and the locking member to selectively lock the handle in several distinct rotational positions.

23 Claims, 9 Drawing Sheets

U.S. PATENT DOCUMENTS 5,324,094 6/1994 Kain ..... 297/183
5,385,387 1/1995 Kain ..... 297/256.16
5,409,292 4/1995 Kain et al. ..... 297/183.1
5,478,135 12/1995 Kain ..... 297/256.16
5,522,639 6/1996 Jaime ..... 297/183.3
5,564,778 10/1996 Shimer et al. ..... 297/130
5,567,008 10/1996 Cone ..... 297/256.16
5,575,530 11/1996 Harper et al. ..... 297/260.2
5,581,234 12/1996 Emery et al. ..... 340/457.1

JUVENILE CARRIER WITH ADJUSTABLE HANDLE ASSEMBLY

RELATED APPLICATIONS

This application is related to several other patent applications which are commonly owned by the Assignee of this application. Those related applications are: U.S. patent application, Ser. No. 08/927,398 entitled Juvenile Carrier with Movable Canopy and U.S. patent application Ser. No. 29/076,579 now U.S. Pat. No. D402,235 issued Dec. 8, 1998 entitled Car Seat and Stroller Combination, which are both hereby incorporated by reference.

BACKGROUND OF THE INVENTION

1. Field of Invention

The present invention relates to a juvenile carrier (a bassinet, a car seat or similar device used to carry or transport a juvenile) with an adjustable handle assembly.

2. Description of Related Art

Conventional juvenile carriers with adjustable handles suffer from several disadvantages. In the past, adjustable handles contained complex adjustment mechanisms. This made the juvenile carriers with adjustable handles extremely expensive and difficult to assemble.

Later, adjustable handles became less complex. Although this technique reduced cost and assembly times, conventional juvenile carriers with adjustable handles suffer from several disadvantages/problems. Conventional juvenile carriers with adjustable handles are difficult to operate and do not provide sufficiently rigid locking. Because conventional juvenile carriers with adjustable handles have become less complex to reduce cost and assembly times, they have become less safe. The adjustable handle of a juvenile carrier must be able to withstand large forces (torsional and load forces associated with carrying a juvenile, as well as forces associated with accidental dropping or falls). During a fall by the person carrying a juvenile carrier or an accidental dropping of a juvenile carrier, the adjustable handle assembly may experience forces exceeding several hundred pounds.

Accordingly, there is a need for an improved juvenile carrier (a bassinet, a car seat or similar device used to carry or transport a juvenile) with an adjustable handle assembly which is inexpensive, easy to assemble, and able to withstand large forces.

SUMMARY OF THE INVENTION

Accordingly, the present invention is directed to an improved juvenile carrier (a bassinet, a car seat or similar device used to carry or transport a juvenile) with an adjustable handle assembly which substantially eliminates one or more of the problems or disadvantages found in the prior art.

An object of the present invention is to provide for a juvenile carrier with an adjustable handle with an improved ease of assembly.

Another objective of the present invention is to provide a juvenile carrier with a handle assembly capable of adjustment to several fixed positions.

Another objective of the present invention is to provide for easy and reliable adjustment of the handle assembly.

Another object of the present invention is to reduce the cost and complexity of manufacturing the juvenile carrier and its various components.

Another object of the invention is to strengthen the connection of the adjustable handle assembly to the juvenile carrier.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the invention, as embodied and broadly described, the invention contemplates a juvenile carrier including a frame with a seating portion for receiving a juvenile and a locking member receiving portion, a locking member adapted to engage the locking member receiving portion, a handle rotatably connected to the frame, and a handle actuator disposed proximate to the handle, wherein the handle actuator is adapted to engage and move the locking member in an axial direction to allow the handle to be adjusted to and locked in a plurality of rotational positions.

In another aspect, the invention contemplates an adjustable handle assembly including a rotatable handle, a handle actuator disposed proximate to the handle, and a locking member disposed proximate to the handle actuator, wherein the handle actuator is adapted to engage and move the locking member in an axial direction to allow the handle to be adjusted to and locked in a plurality of rotational positions.

In a further aspect, the invention contemplates a juvenile carrier including a frame including a seating portion for receiving a juvenile and a locking member receiving portion, a circular locking member adapted to engage the locking member receiving portion, a handle rotatably connected to the frame, and a handle actuator disposed proximate to the handle, wherein the circular locking member includes a plurality of teeth disposed about its circumference and is adapted to engage the handle and the locking member to selectively lock the handle in several distinct rotational positions.

In yet a further aspect, the invention contemplates an adjustable handle assembly including a rotatable handle, a handle actuator disposed proximate to the handle, and a circular locking member disposed proximate to the handle actuator, wherein the circular locking member includes a plurality of teeth disposed about its circumference and is adapted to engage the handle and the locking member to selectively lock the handle in several distinct rotational positions.

It is to be understood that both the general description above, and the following detailed description are exemplary and explanatory and are intended to provide further explanation of the invention as claimed.

BRIEF DESCRIPTION OF THE DRAWINGS

The accompanying drawings which are included to provide a further understanding of the invention and constitute a part of this specification, illustrate embodiments of the invention and together with the written description, serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1A:
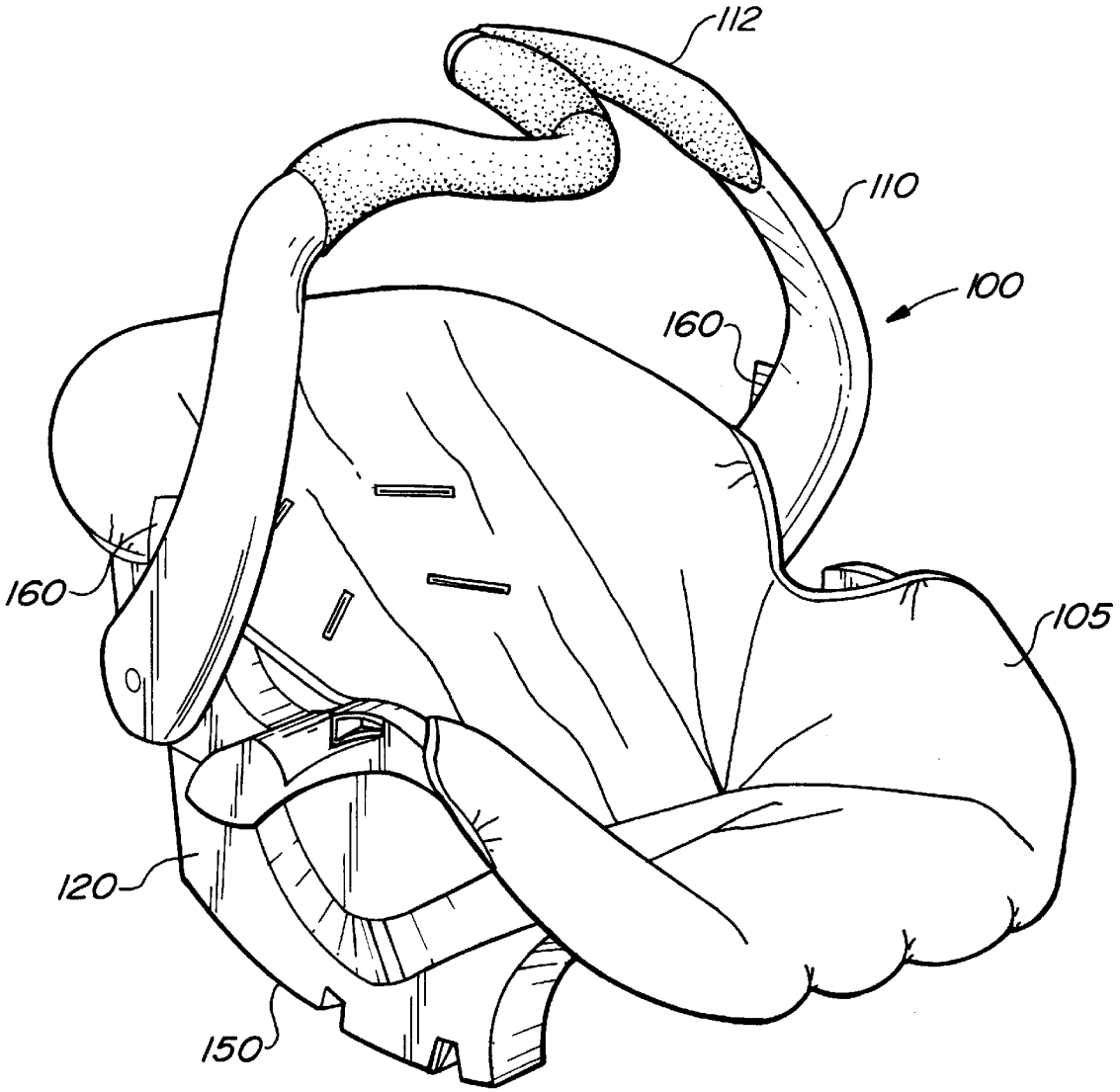
FIG. 1A is an isometric view of a juvenile carrier with an adjustable handle according to a preferred embodiment of the present invention.

In accordance with the objects of the present invention, the juvenile carrier includes a frame including a seating portion for receiving a juvenile and a locking member receiving portion, a locking member adapted to engage the locking member receiving portion, a handle rotatably connected to the frame, and a handle actuator disposed proximate to the handle. For example, FIG. 1A shows an isometric view of a juvenile carrier with an adjustable handle assembly according to a preferred embodiment of the present invention.

Juvenile carrier 100 includes frame 120, padded seating portion 105, adjustable handle 110, handle gripping portion 112, and handle actuators 160. According to a preferred embodiment of the present invention, the frame 120 of juvenile carrier 100 includes curved rocking base 150. Frame 120 and adjustable handle 110 may be constructed of any appropriate rigid material. For example, frame 120 and adjustable handle 110 may be constructed of metal or a high-strength plastic. Preferably, frame 120 and adjustable handle 110 may be constructed of an injection molded plastic. Finally, although the present invention is shown as a bassinet or car seat, the fundamentals of the present invention are equally applicable to any similar device used to carry or transport a juvenile.

Figure 1B:
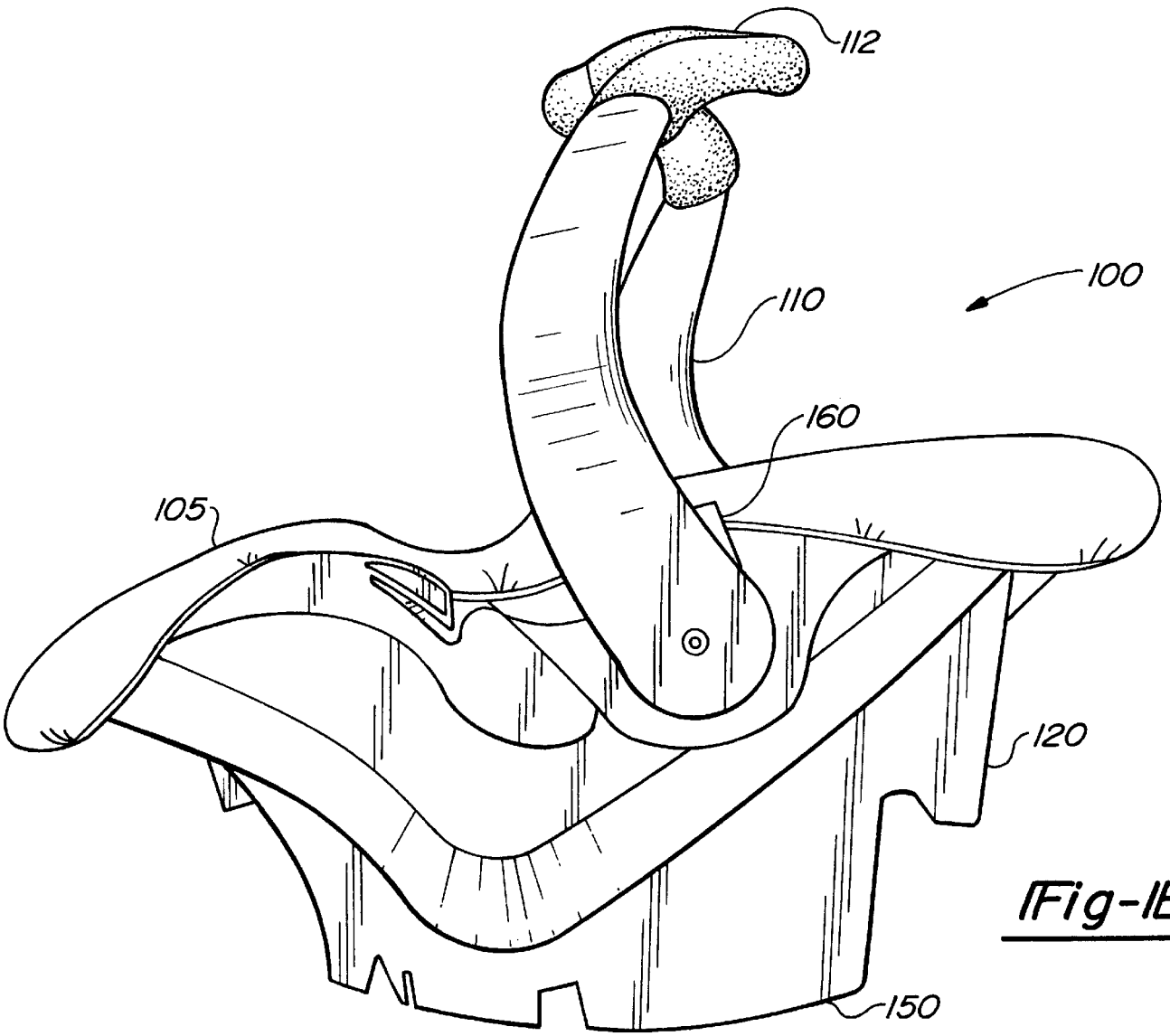
FIG. 1B is a side view of a preferred juvenile carrier with an adjustable handle in accordance with the present invention.

FIG. 1B shows side view of a preferred juvenile carrier with an adjustable handle in accordance with the present invention. As can be seen in this side view, as well as in FIG. 1A, the handle gripping portion 112 of the present invention extends along a substantial portion of the horizontal portion of adjustable handle 110. This allows the person carrying the juvenile carrier 100 to comfortably grip handle 110 at any point along handle gripping portion 112. The adjustable handle of a preferred juvenile carrier in accordance with the present invention is adapted to be locked in several distinct rotational positions including, but not limited to, a carrying position (shown in FIGS. 1A and 1B), a stored position (handle doesn't impede direct access to the juvenile in the carrier), and a non-rocking position (where the handle prevents rocking of the juvenile carrier on curved rocking base 150).

Figure 2:
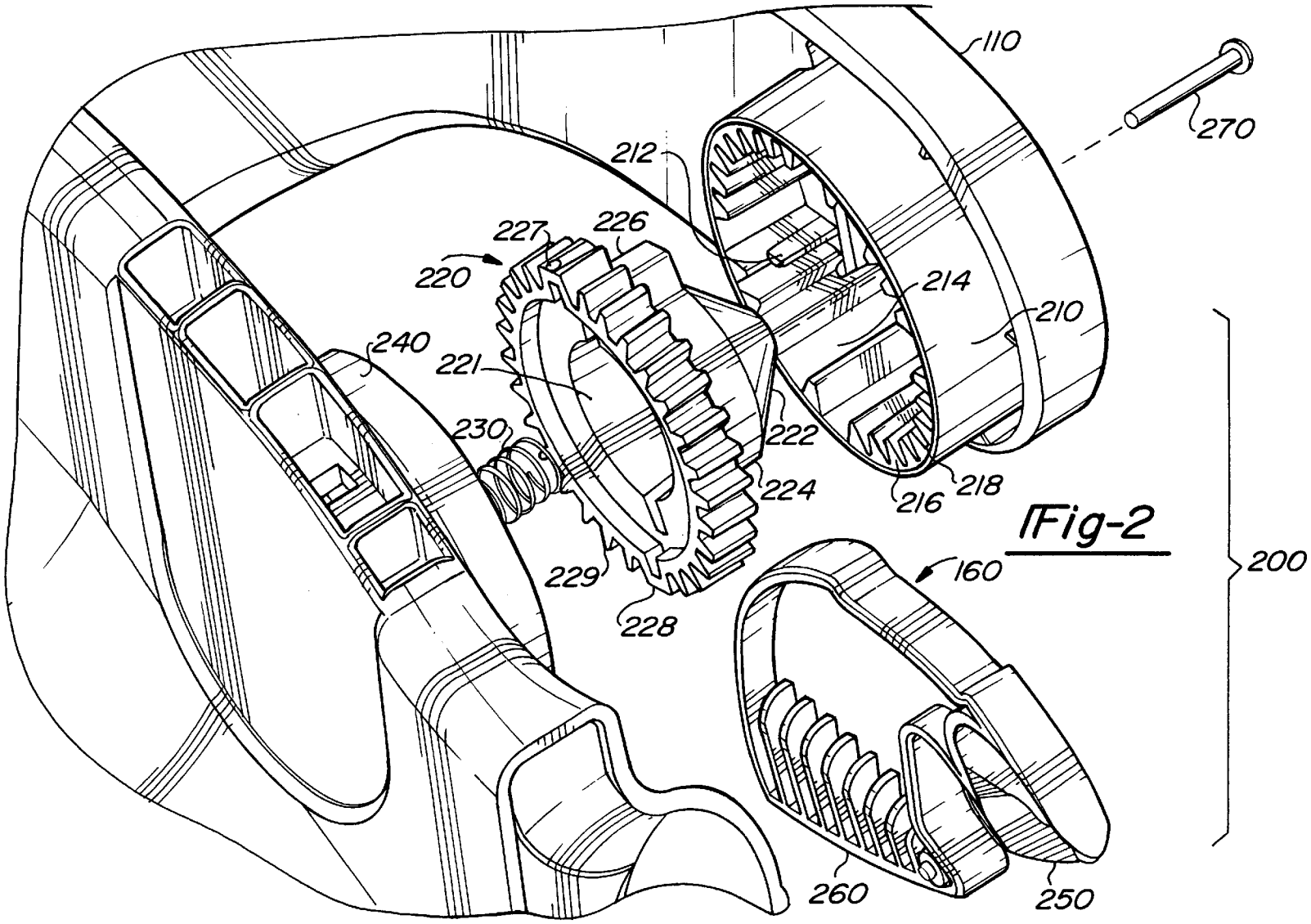
FIG. 2 is an exploded isometric view of an adjustable handle assembly of a preferred juvenile carrier in accordance with the present invention.

FIG. 2 shows an exploded isometric view of an adjustable handle assembly 200 of a preferred juvenile carrier in accordance with the present invention. The adjustable handle assembly 200 of the present invention includes handle 110, handle actuator 160, locking member 220, and locking member receiving portion 240.

The adjustable handle assembly of the preferred juvenile carrier according to the present invention includes a locking member including a circular portion, a recess portion, a conical portion, and includes a plurality of teeth including at least one key tooth arranged circumferentially about the circular portion. For example, as shown in FIG. 2, the adjustable handle assembly 200 includes locking member 220. Locking member 220 includes recess portion 221, conical portion 222, cylindrical portion 224, alignment locking tabs 227, plurality of teeth 229 including at least one key tooth 228, and over-rotation prevention tabs 226. Locking member 220 may be constructed of any appropriate rigid material. For example, locking member 220 may be constructed of metal or a high-strength plastic. Preferably, locking member 220 may be constructed of an injection molded plastic.

The adjustable handle assembly of the preferred juvenile carrier according to the present invention includes a handle including a circumferential portion and includes a plurality of locking ridges arranged about the circumferential portion adapted to selectively lockingly engage the plurality of teeth of the locking member, wherein the selective locking engagement of the at least one key tooth in the locking ridges corresponds to a single distinct rotational position of the handle. Furthermore, the handle of the adjustable handle assembly of the preferred juvenile carrier according to the present invention includes over-rotation prevention tabs. For example, FIG. 2 shows handle 110 which includes circumferential portion 210, over-rotation prevention tabs 212, and locking ridges 216. The small gaps 218 and large gaps 214 are formed between locking ridges 216. Large gaps 214 are adapted to engage the at least one key tooth 228, or two teeth 229, while small gaps 218 are adapted to engage a single tooth 229 and will not receive the key tooth 228 due to their size. The over-rotation prevention tabs 212 of handle 110 are adapted to engage the over-rotation prevention tabs 226 of locking member 220 to limit the extent of rotation of the handle 110 with respect to locking member 220. Handle 110 and locking ridges 216 may be constructed of any appropriate rigid material. For example, handle 110 and locking ridges 216 may be constructed of metal or a high-strength plastic. Preferably, handle 110 and locking ridges 216 may be constructed of an injection molded plastic.

The adjustable handle assembly of the preferred juvenile carrier according to the present invention includes a handle actuator including a cam portion and a contact portion, wherein the cam portion is adapted to receive the conical portion of the locking member to convert curvilinear translation of the handle actuator into axial translation of the locking member. For example, FIG. 2 shows handle actuator 160 including cam portion 250 and contact portion 260. Handle actuator 160 is adapted to be received in handle 110. When inserted in handle 110, the cam portion 250 of handle actuator 160 is adapted to receive the conical portion 222 of the locking member 220 to convert curvilinear translation of the handle actuator 160 into axial translation of the locking member 220. Handle actuator 160 may be constructed of any appropriate rigid material. For example, handle actuator 160 may be constructed of metal or a high-strength plastic. Preferably, handle actuator 160 may be constructed of an injection molded plastic.

The adjustable handle assembly of the preferred juvenile carrier according to the present invention includes a spring received in the recess portion of the locking member to urge the conical portion of the locking member towards the handle. For example, FIG. 2 shows biasing spring 230 which is received in recess portion 221 and biases against an inner portion of locking member receiving portion 240 to urge locking member 220 and conical portion 222 towards handle 110.

Finally, FIG. 2 shows axle/pin 270 which passes through handle 110, handle actuator 160, locking member 220, biasing spring 230, and locking member receiving portion 240 to secure the entire assembly together. According to a preferred embodiment of the present invention, the adjustable handle of the juvenile carrier includes a shoulder screw as axle/pin 270. However, it should be understood that axle/pin 270 could be formed from any appropriate attachment mechanism such as a screw, a bolt, or a shaft with a lock pin.

Figure 3A:
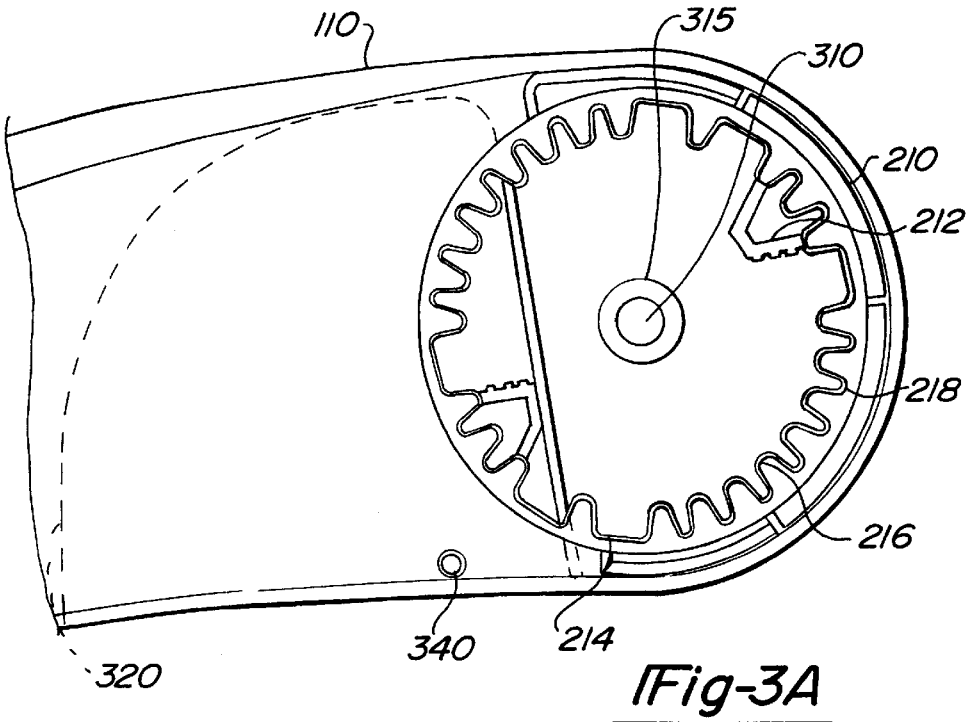
FIG. 3A is a front view of a portion of a handle of a preferred juvenile carrier with an adjustable handle in accordance with the present invention.

FIG. 3A shows a front view of a portion of a handle of a preferred juvenile carrier with an adjustable handle in accordance with the present invention. As shown in FIG. 3A handle 110 includes circumferential portion 210, over-rotation prevention tabs 212, locking ridges 216, small gaps 218, and large gaps 214. Furthermore, handle 110 includes actuator receiving cavity 320 (shown in phantom), axle hole 310, and raised cylindrical boss 315. Handle 110 also includes through hole 340 which is adapted to receive a first rotation tab on handle actuator 160. According to a preferred embodiment of the present invention, the adjustable handle of the juvenile carrier includes three distinct locking positions. However, it should be understood that any number of distinct locking positions could be accommodated without departing from the spirit and scope of the invention.

Figure 3B:
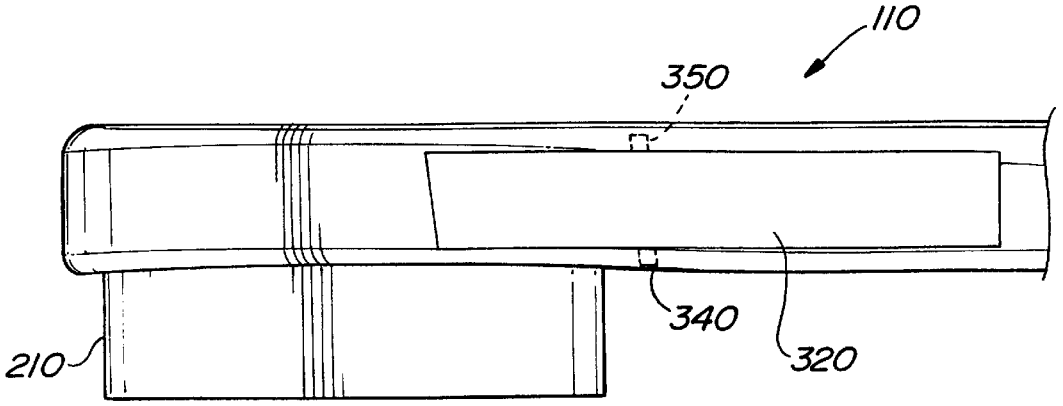
FIG. 3B is a bottom view of a portion of a handle of a preferred juvenile carrier with an adjustable handle in accordance with the present invention.

FIG. 3B shows a bottom view of a portion of a handle of a preferred juvenile carrier with an adjustable handle in accordance with the present invention. As shown in this figure, in addition to through hole 340, actuator receiving cavity 320 also includes blind hole 350. Blind hole 350 is adapted to receive a second rotation tab on handle actuator 160.

Figure 4A:
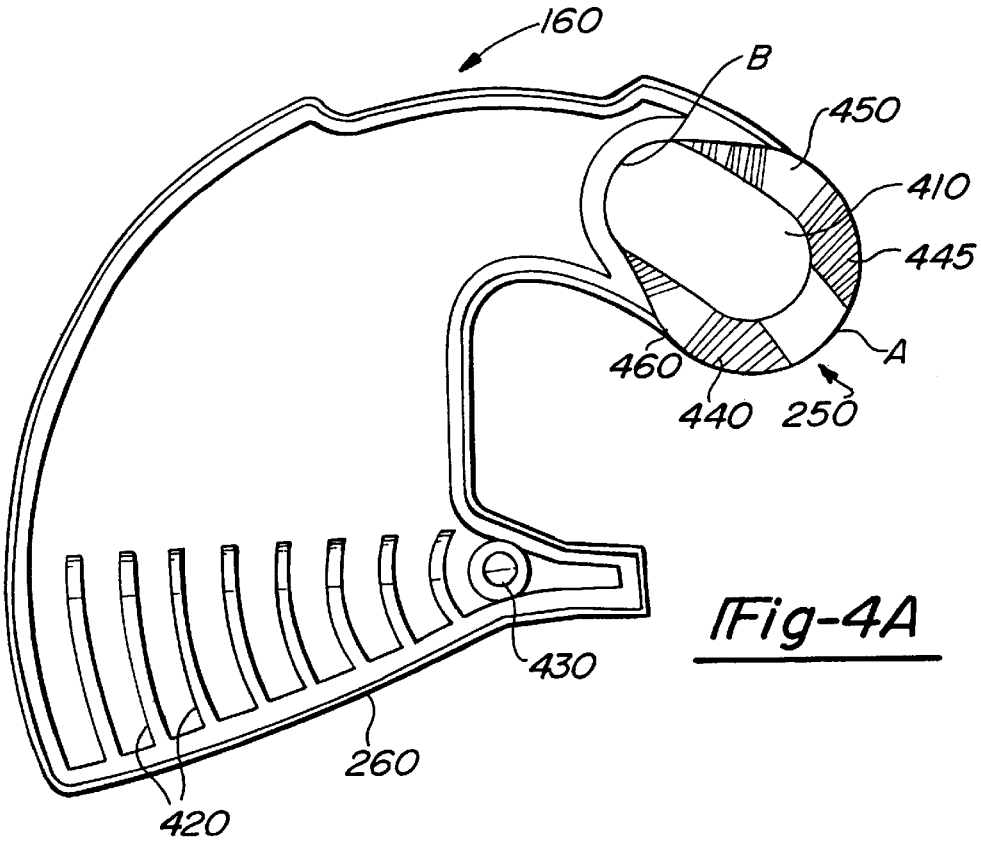
FIG. 4A is a front view of a handle actuator of a preferred juvenile carrier with an adjustable handle in accordance with the present invention.

FIG. 4A shows a front view of a handle actuator of a preferred juvenile carrier with an adjustable handle in accordance with the present invention. Handle actuator 160 includes cam portion 250, contact portion 260, boss receiving opening 410, finger protection ridges 420, and first rotation tab 430. Cam portion 250 is made up by ramp portions 440 and 445, and beveled sides 450 and 460. The thickness of handle actuator 160 gradually increases from point A to point B.

Figure 4B:
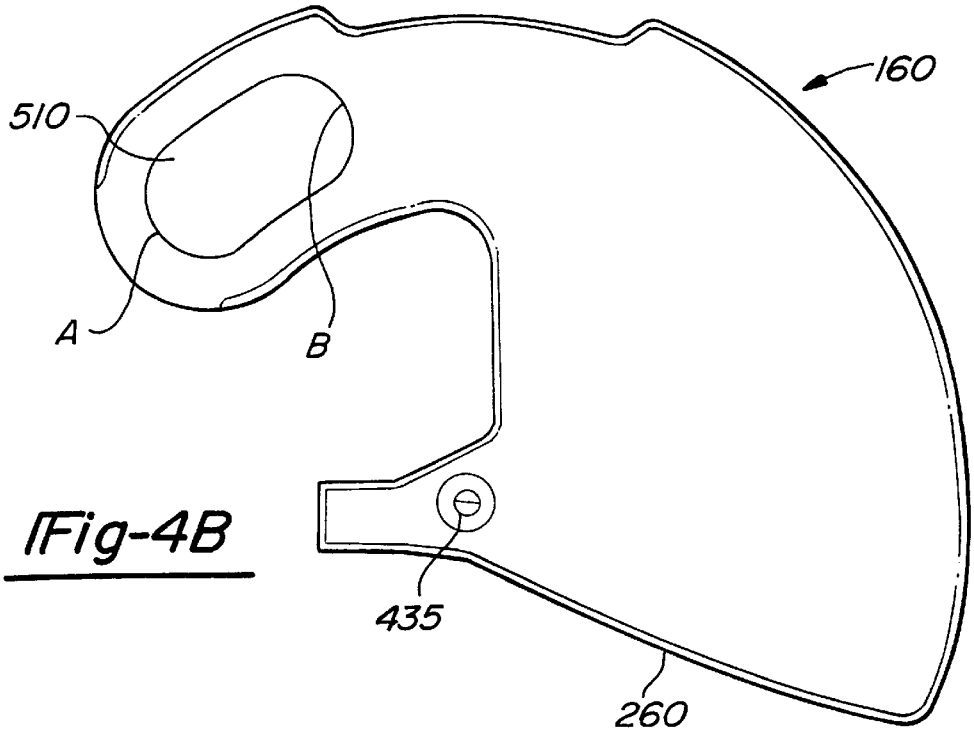
FIG. 4B is a rear view of a handle actuator of a preferred juvenile carrier with an adjustable handle in accordance with the present invention.

FIG. 4B shows a rear view of a handle actuator of a preferred juvenile carrier with an adjustable handle in accordance with the present invention. As mentioned above, handle actuator 160 includes contact portion 260 and boss receiving opening 410. The rear of handle actuator 160 includes second rotation tab 435.

Figure 5A:
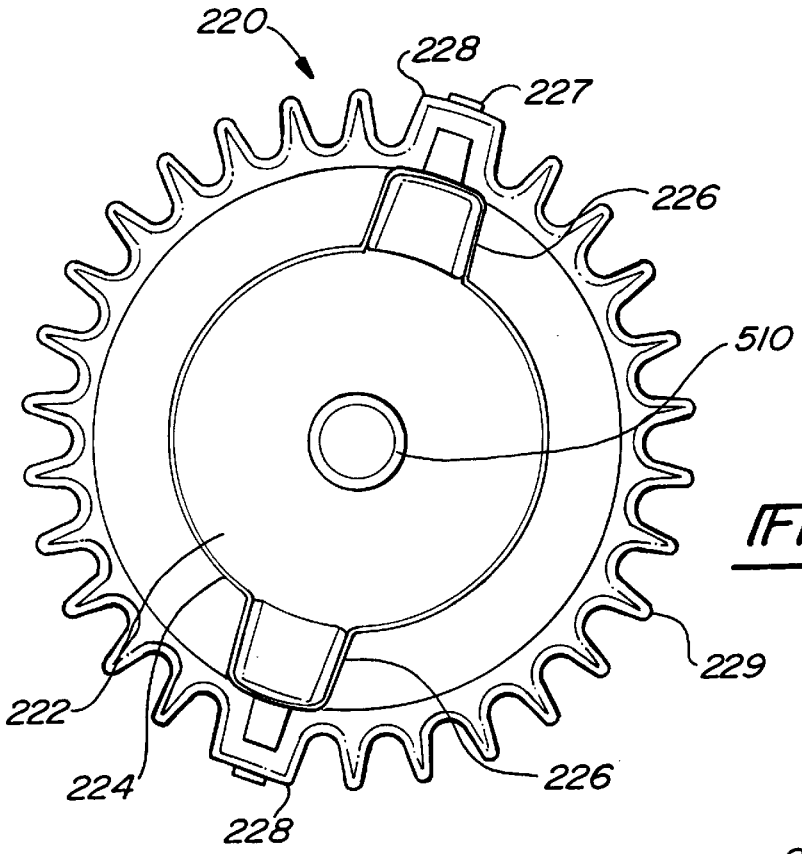
FIG. 5A is a front view of a locking member of a preferred juvenile carrier with an adjustable handle in accordance with the present invention.

FIG. 5A shows a front view of a locking member of a preferred juvenile carrier with an adjustable handle in accordance with the present invention. Locking member 220 includes conical portion 222, cylindrical portion 224, alignment locking tabs 227, plurality of teeth 229 including at least one key tooth 228, over-rotation prevention tabs 226, and pin/axle hole 510.

Figure 5B:
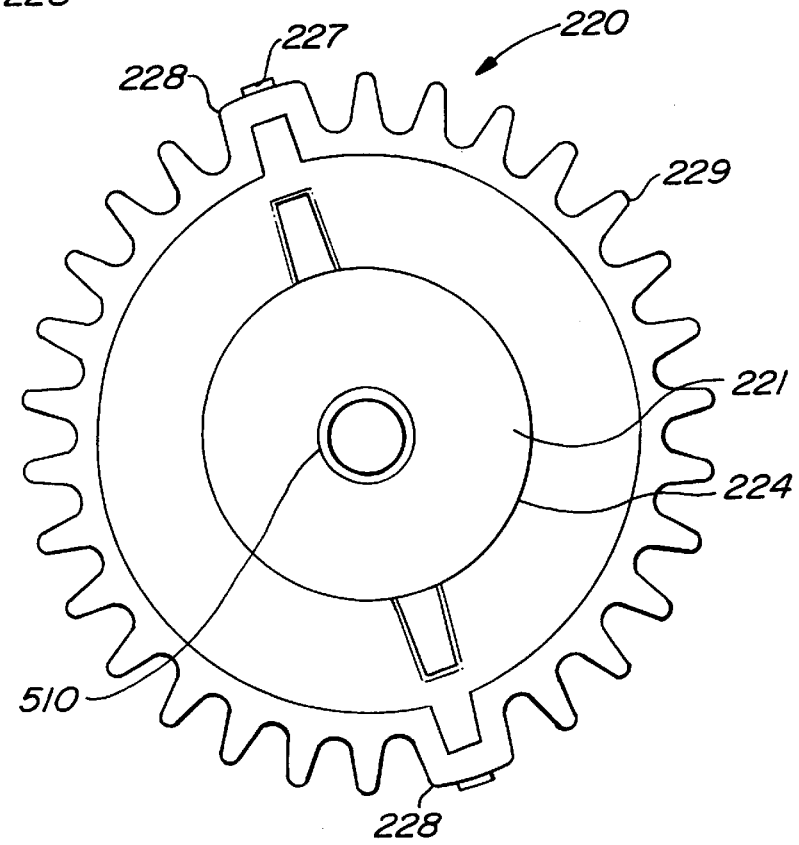
FIG. 5B is a rear view of a locking member of a preferred juvenile carrier with an adjustable handle in accordance with the present invention.

FIG. 5B shows a rear view of a locking member of a preferred juvenile carrier with an adjustable handle in accordance with the present invention. As shown in FIG. 5B, locking member 220 further includes recess portion 221.

Figure 6A:
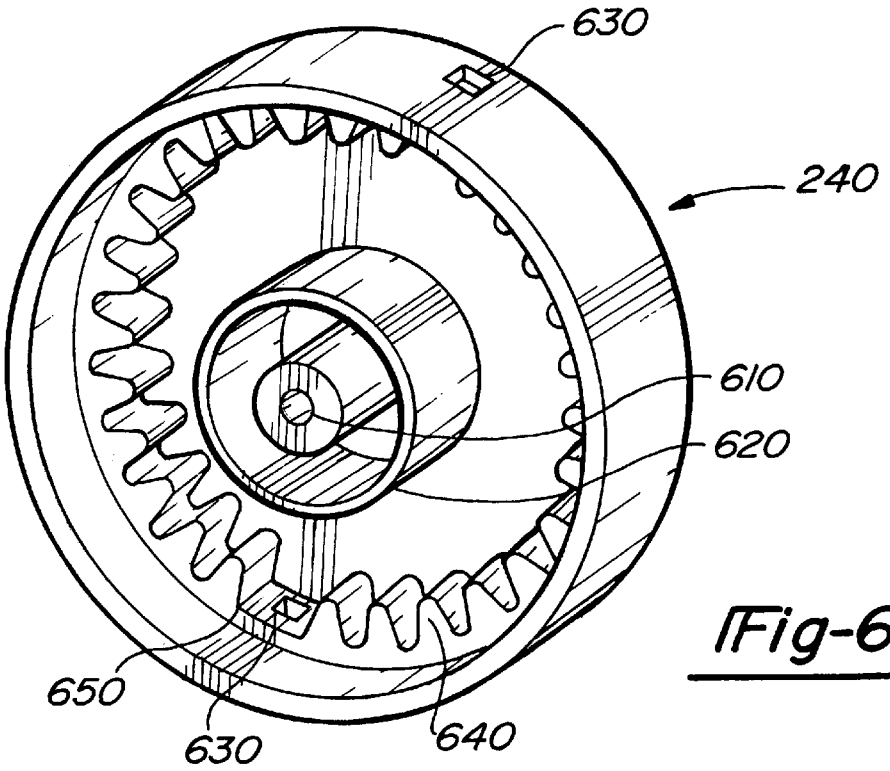
FIG. 6A is an isometric view of a locking member receiving portion of a preferred juvenile carrier with an adjustable handle in accordance with the present invention.
Figure 6B:
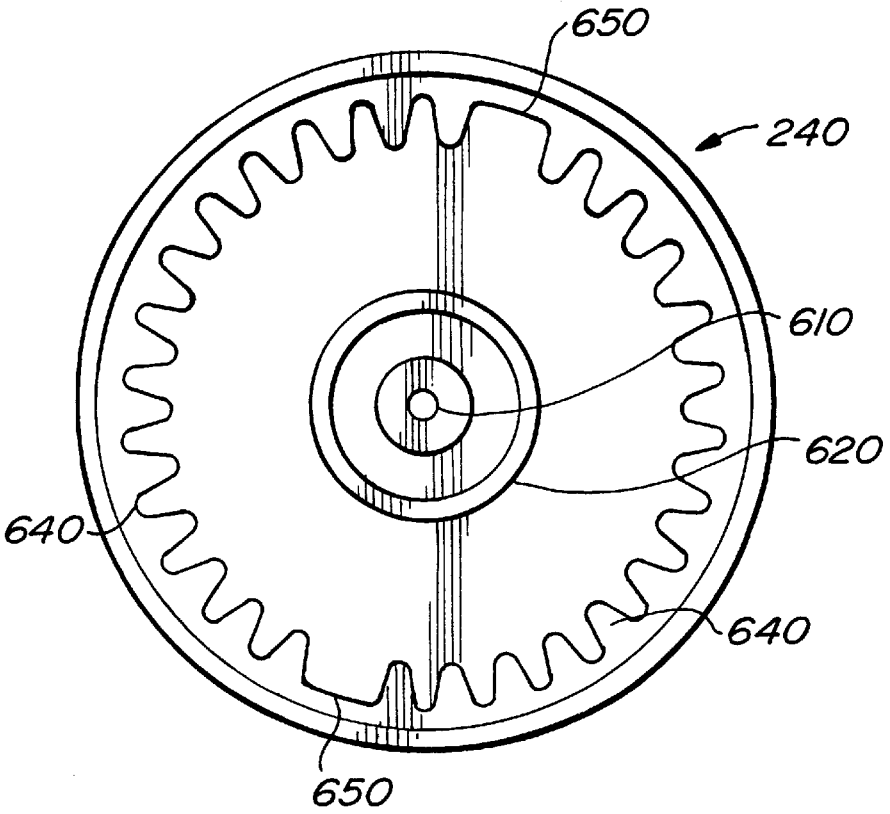
FIG. 6B is a front view of a locking member receiving portion of a preferred juvenile carrier with an adjustable handle in accordance with the present invention.

FIG. 6A shows an isometric view of a locking member receiving portion of a preferred juvenile carrier with an adjustable handle in accordance with the present invention. Locking member receiving portion 240 in accordance with the present invention includes pin/axle receiving bore 610, spring mounting surface 620, locking tab receiving cut-outs 630, locking ridges 640, and key receiving gaps 650. As shown in FIG. 6B (a front view of a locking member receiving portion of a preferred juvenile carrier with an adjustable handle in accordance with the present invention), key receiving gaps 650 are designed to receive key teeth 228, while locking ridges 640 are designed to receive teeth 229. During assembly, spring 230 is placed between pin/axle receiving bore 610 and spring mounting surface 620. Next, locking member 220 is placed into locking member receiving portion 240 until alignment locking tabs 227 engage locking tab receiving cut-outs 630. Therefore, locking member 220 is biased away from the locking member receiving portion 240.

As can be seen in FIG. 6A, the locking tab receiving cut-outs 630 are longer in the axial direction than alignment locking tabs 227. Thus, locking member 220 is able to move axially (when biasing spring 230 is compressed) with respect to locking member receiving portion 240 without becoming disengaged from locking member receiving portion 240. Furthermore, locking member 220 is prevented from rotating with respect to locking member receiving portion 240.

Now, the adjustment of the handle 110 of the juvenile carrier 100 will be described in detail with reference to FIGS. 7A–7C.

Figure 7A:
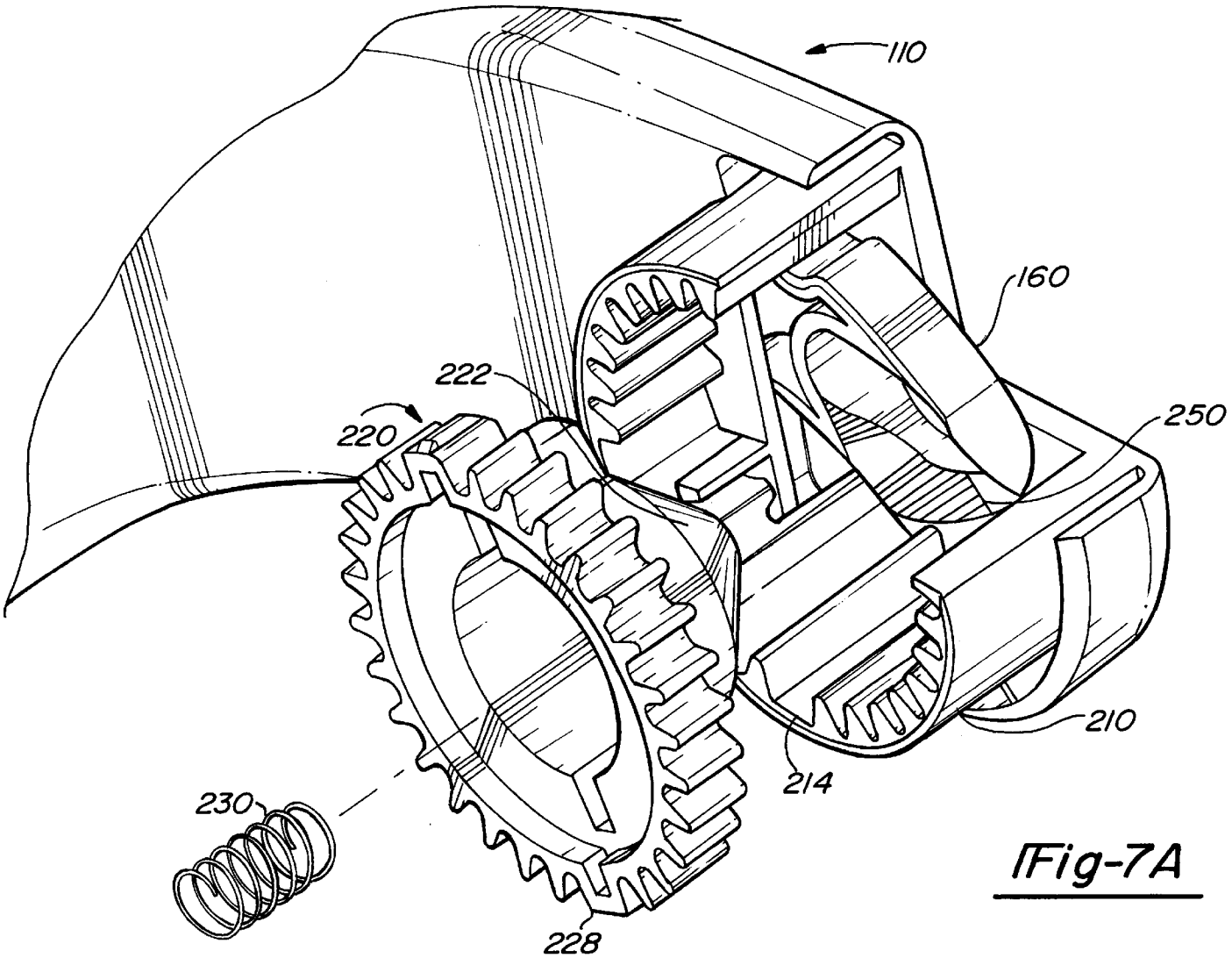
FIG. 7A is an exploded isometric partial cut-away view of a portion of an adjustable handle assembly of a preferred juvenile carrier in accordance with the present invention.

FIG. 7A is a exploded isometric partial cut-away view of a portion of an adjustable handle assembly of a preferred juvenile carrier with an adjustable handle in accordance with the present invention. As shown in FIG. 7A, biasing spring 230 urges the conical portion 222 of locking member 220 towards handle actuator 160 in handle 110. During assembly, handle actuator 160 is placed in actuator receiving cavity 320 in handle 110. This is achieved by snapping first and second rotation tabs 430 and 435 into through hole 340 and blind hole 350 respectively. Furthermore, boss receiving opening 410 is snapped over raised cylindrical boss 315.

Figure 7B:
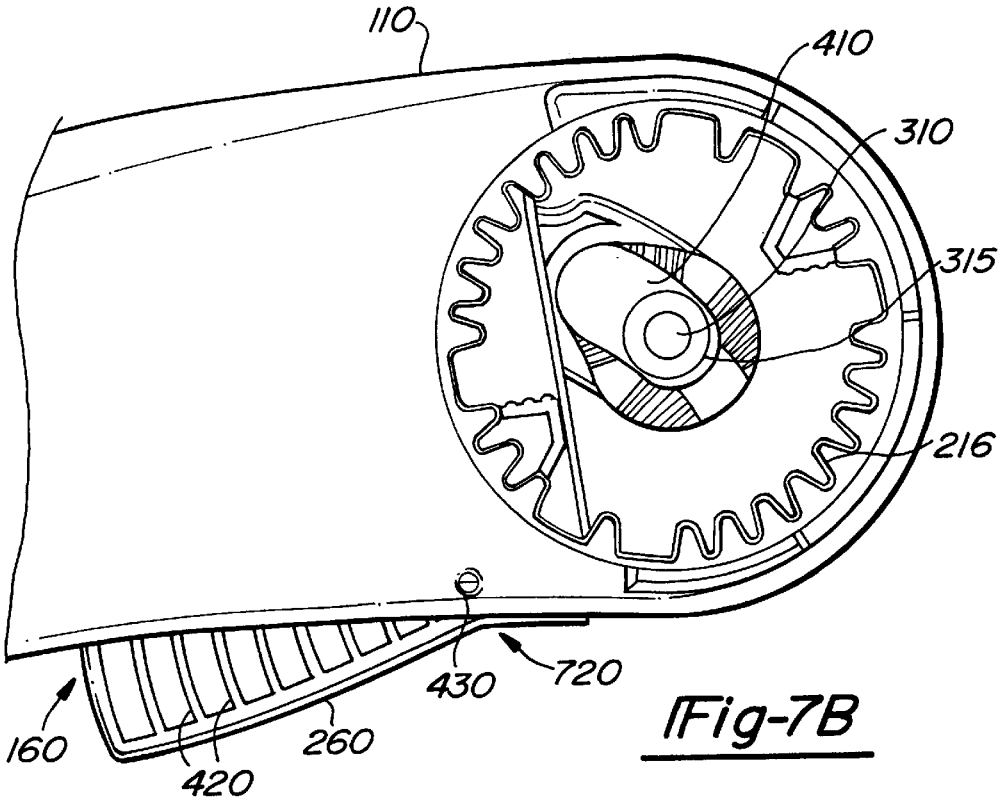
FIG. 7B is a front view of a portion of a handle and handle actuator of a preferred juvenile carrier with an adjustable handle in accordance with the present invention shown in the normal position (non-actuated)

FIG. 7B shows a front view of a portion of a handle and handle actuator of a preferred juvenile carrier with an adjustable handle in accordance with the present invention shown in the normal position. As shown in this figure, when in the normal (non-actuated) position 720, handle actuator 160 protrudes from handle 110. Finger protection ridges 420 prevent the child fingers from being pinched by handle actuator 160 during use. Because conical portion 222 of locking member 220 is biased against cam portion 250 of handle actuator 160, the handle actuator is automatically rotated to this normal (non-actuated) position 720. In this position, teeth 229 on locking member 220 are engaged by locking ridges 216 of handle 110 and rotation of handle 110 with respect to locking member 220, locking member receiving portion 240, and juvenile carrier 100 is prevented.

Figure 7C:
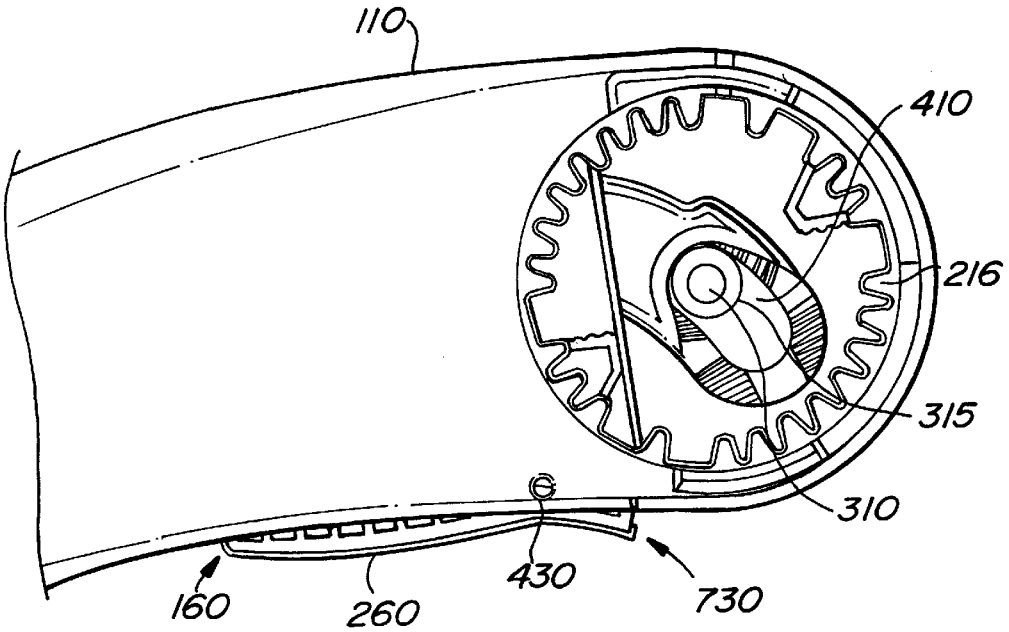
FIG. 7C is a front view of a portion of a handle and handle actuator of a preferred juvenile carrier with an adjustable handle in accordance with the present invention shown in the actuated position.

FIG. 7C shows a front view of a portion of a handle and handle actuator of a preferred juvenile carrier with an adjustable handle in accordance with the present invention shown in the actuated position. As shown in this figure, when in the actuated position 730, handle actuator 160 has been pressed into handle 110. As handle actuator 160 is rotated about rotation tabs 430 and 435, cam portion 250 forces conical portion 222 of locking member 220 outward toward locking member receiving portion 240. Thus, locking member 220 moves further into locking member receiving portion 240. At this point, teeth 229 on locking member 220 are disengaged from locking ridges 216 of handle 110. Thus, handle 110 may be rotated with respect to locking member 220, locking member receiving portion 240, and juvenile carrier 100. During rotation, once the key tooth 228 of locking member 220 reaches one of the distinct locking positions in handle 110, biasing spring 230 automatically pushes conical portion 222 of locking member 220 toward cam portion 250. Thus, handle actuator 160 is pushed toward the normal (non-actuated) position 720 and teeth 228 and 229 are again engaged by locking ridges 216. Thus, it may be said that the handle actuator is adapted to engage and move the locking member in an axial direction to allow the handle to be adjusted to and locked in a plurality of rotational positions, and the locking member includes a plurality of teeth disposed about its circumference and is adapted to engage the handle and the locking member to selectively lock the handle in several distinct rotational positions.

As illustrated in the detailed description, the juvenile carrier with an adjustable handle assembly in accordance with the present invention substantially eliminates one or more of the problems or disadvantages found in the prior art. The novel structure, as particularly pointed out in the written description and claims hereof as well as the appended drawings, provides an adjustable handle which is easily operable and which returns to a locked position automatically upon rotation of the handle to a selected position. Also, because the locking member of the present invention engages the adjustable handle over a greater surface area, preferably over its entire circumference (i.e. 360 degrees), the adjustable handle assembly of the present invention is able to withstand greater forces without failure.

It will be apparent to those skilled in the art that various modifications and variations can be made in the juvenile carrier with an adjustable handle assembly of the present invention without departing from the spirit or scope of the invention. Thus, it is intended that the present invention cover the modifications and variations of this invention provided they come within the scope of the appended claims and their equivalents.

What is claimed is:

1. A juvenile carrier comprising:

a frame including a seating portion for receiving a juvenile and a locking member receiving portion;

a locking member adapted to engage the locking member receiving portion, the locking member comprises a cylindrical portion and includes a plurality of teeth including at least one key tooth arranged circumferentially about the cylindrical portion, the locking member comprises a recess portion extending into at least a portion of said cylindrical portion and a conical portion outwardly extending from said cylindrical portion;

a handle rotatably connected to the frame; and a handle actuator disposed proximate to the handle, wherein the handle actuator is adapted to engage and move the locking member in an axial direction to allow the handle to be adjusted to and locked in a plurality of rotational positions.

2. The juvenile carrier of claim 1 wherein the handle actuator comprises a cam portion and a contact portion, wherein the cam portion is adapted to receive the conical portion of the locking member to convert curvilinear translation of the handle actuator into axial translation of the locking member.

3. The juvenile carrier of claim 1 further comprising a spring received in the recess portion to urge the conical portion towards the handle.

4. An adjustable handle assembly comprising:

a handle, said handle being rotatable;

a handle actuator disposed proximate to the handle; and a locking member disposed proximate to the handle actuator and releasably engaging said handle, the locking member comprises a cylindrical portion, and a plurality of teeth including at least one key tooth arranged circumferentially about the cylindrical portion, the locking member comprises a recess portion extending into at least a portion of said cylindrical portion and a conical portion outwardly extending from said cylindrical portion;

wherein the handle is rotatable when said locking member is axially disengaged from said handle and locked by said locking member when said locking member is axially engaged with said handle.

5. The adjustable handle assembly of claim 4 wherein the handle actuator comprises a cam portion, wherein the cam portion is adapted to receive the conical portion of the locking member to convert curvilinear motion of the handle actuator into axial motion of the locking member.

6. The adjustable handle assembly of claim 4 further comprising a spring received in the recess portion to urge the conical portion towards the handle.

7. A juvenile carrier comprising:

a frame including a seating portion for receiving a juvenile and a locking member receiving portion;

a circular locking member adapted to engage the locking member receiving portion;

a handle rotatably connected to the frame, said handle defining an axis about which said handle rotates; and a handle actuator disposed proximate to the handle, said handle actuator being disposed approximately perpendicularly relative to said axis, wherein the circular locking member includes a plurality of teeth disposed about its circumference and is adapted to engage the handle and the locking member to selectively lock the handle in several distinct rotational positions.

8. The juvenile carrier of claim 7 wherein the handle includes a cavity adapted to receive the handle actuator.

9. The juvenile carrier of claim 7 wherein the circular locking member comprises a plurality of teeth including at least one key tooth arranged circumferentially about the circular locking member.

10. The juvenile carrier of claim 9 wherein the circular locking member comprises a recessed portion extending into at least a portion of said cylindrical portion; and a conical portion outwardly extending from said cylindrical portion.

11. The juvenile carrier of claim 9 wherein the locking member receiving portion comprises a circumferential portion and includes a plurality of locking ridges arranged about the circumferential portion adapted to lockingly engage the plurality of teeth.

12. The juvenile carrier of claim 9 wherein the handle comprises a circular portion; and a plurality of locking ridges arranged circumferentially about the circular portion, the plurality of locking ridges adapted to selectively lockingly engage the plurality of teeth substantially about 360 degrees, wherein the selective locking engagement of the at least one key tooth in the locking ridges corresponds to a single distinct rotational position of the handle.

13. The juvenile carrier of claim 10 wherein the handle actuator comprises a cam portion, wherein the cam portion is adapted to receive the conical portion of the circular locking member to convert curvilinear motion of the handle actuator into axial motion of the locking member.

14. The juvenile carrier of claim 10 further comprising a spring received in the recess portion to urge the conical portion towards the handle.

15. The juvenile carrier of claim 9 wherein the handle comprises at least one over-rotation prevention tab disposed on the circumferential portion, and wherein the locking member includes at least one over-rotation prevention tab extending from said cylindrical portion.

16. An adjustable handle assembly comprising:

a handle, said handle having an axis about which said handle rotates;

a handle actuator disposed proximate to the handle, said handle actuator being disposed in a plane approximately perpendicularly relative to said axis of said handle; and a circular locking member disposed proximate to the handle actuator, wherein the circular locking member includes a plurality of teeth disposed about its circumference and is adapted to engage the handle and the locking member to selectively lock the handle in several distinct rotational positions.

17. The adjustable handle assembly of claim 16 wherein the handle includes a cavity adapted to receive the handle actuator.

18. The adjustable handle assembly of claim 16 wherein the plurality of teeth disposed on the circular locking member comprises at least one key tooth.

19. The adjustable handle assembly of claim 18 wherein the circular locking member comprises a recess portion extending into at least a portion of said cylindrical portion; and a conical portion outwardly extending from said cylindrical portion.

20. The adjustable handle assembly of claim 19 wherein the handle comprises a circumferential portion; and a plurality of locking ridges arranged about the circumferential portion adapted to selectively lockingly engage the plurality of teeth substantially about 360 degrees, wherein the selective locking engagement of the at least one key tooth in the locking ridges corresponds to a single distinct rotational position of the handle.

21. The adjustable handle assembly of claim 9 wherein the handle actuator comprises a cam portion, wherein the cam portion is adapted to receive the conical portion of the circular locking member to convert curvilinear motion of the handle actuator into axial motion of the locking member.

22. The adjustable handle assembly of claim 19 further comprising a spring received in the recess portion to urge the conical portion towards the handle.

23. The adjustable handle assembly of claim 16 wherein the handle comprises at least one over-rotation prevention tab disposed on the circumferential portion and wherein the locking member includes at least one over-rotation prevention tab extending from said cylindrical portion.

* * * * *